United States Patent [19]

Yamauchi et al.

[11] 4,325,341

[45] Apr. 20, 1982

[54] FUEL CONTROL DEVICE FOR FUEL INJECTION SYSTEM FOR INTERNAL COMBUSTION ENGINE

[75] Inventors: Teruo Yamauchi; Yoshishige Oyama, both of Katsuta; Mamoru Fujieda, Ibaraki all of Japan

[73] Assignee: Hitachi, Ltd., Tokyo, Japan

[21] Appl. No.: 91,459

[22] Filed: Nov. 5, 1979

[30] Foreign Application Priority Data

Nov. 6, 1978 [JP] Japan ..... 53-135785

[51] Int. Cl.[3] ..... F02M 51/00

[52] U.S. Cl. ..... 123/472; 123/549; 123/548; 239/533.2; 261/DIG. 39; 261/115

[58] Field of Search ..... 123/472, 470, 531, 549, 123/548, 524, 308, 432; 239/145, 326, 533.2; 261/DIG. 39, DIG. 74, 115

[56] References Cited

U.S. PATENT DOCUMENTS

| | | | |
|---|---|---|---|
| 1,872,931 | 8/1932 | Goldsborough | 123/252 |
| 3,583,635 | 6/1971 | Lemelson | 239/145 |
| 3,656,464 | 4/1972 | Hilborn | 123/470 |
| 3,782,639 | 1/1974 | Boltz et al. | 123/472 |
| 3,937,007 | 2/1976 | Kappler | 239/145 |
| 4,099,492 | 7/1978 | Asaka | 123/274 |
| 4,141,327 | 2/1979 | Marcoux et al. | 123/549 |
| 4,159,703 | 7/1979 | Mayer | 123/472 |
| 4,216,753 | 8/1980 | Inove et al. | 123/472 |

FOREIGN PATENT DOCUMENTS

| | | | |
|---|---|---|---|
| 45-4523238 | 6/1970 | Japan | 239/145 |

*Primary Examiner*—Charles J. Myhre
*Assistant Examiner*—Magdalen Moy
*Attorney, Agent, or Firm*—Craig and Antonelli

[57] ABSTRACT

A fuel control device for a fuel injection system of a type having an intermittent injection type fuel injector disposed in a bore formed in the wall defining an intake passage. The device has a porous tubular element received in the bore in close contact with the fuel injector and defining therein a passage opened at its both ends.

The fuel injected by the fuel injector is adhered to the inner surface of the passage defined in the porous tubular element. Air is introduced into the passage through fine air passages formed in the wall of the porous tubular element. The air introduced into the passage well atomizes the fuel into fine particles and is mixed therewith to form a homogeneous mixture.

14 Claims, 10 Drawing Figures

FUEL CONTROL DEVICE FOR FUEL INJECTION SYSTEM FOR INTERNAL COMBUSTION ENGINE

BACKGROUND OF THE INVENTION

1. Field of the Invention

The present invention relates to a fuel injection system for supplying a fuel to an internal combustion engine and, more particularly, to a fuel control device for a fuel injection system of the type that injects a fuel intermittently.

2. Description of the Prior Art

This type of fuel injection systems is operative to produce pulse signals according to the operating condition of an associated internal combustion engine and to deliver these signals to an electromagnetic fuel injector so that the internal combustion engine is supplied with the fuel intermittently in synchronization with the engine operation.

The intermittent fuel injection systems are sorted into two types, one is the Single Point Injection type and the other is the Multi-point Injection system.

The single point injection system has a single injector adapted for supplying the fuel to all or a half of the cylinders of the internal combustion engine, whereas the multi-point injection system is adapted to supply the fuel to the cylinders by means of injectors associated with respective engine cylinders.

In designing and manufacturing the intermittent fuel injection systems, it is necessary to overcome the following problems (1) and (2).

(1) If the valve-open period of the fuel injector is set to be 2 ms, for example, at an idling speed of 600 R.P.M., the valve-open period will be prolonged to 10 ms, which is longer than the valve-open period of the intake valves, as the engine speed is increased to 3,000 R.P.M. For this reason, it is necessary that the valve-open period of the injector be determined on the basis of the engine speed at the high-speed engine operation. This, however, causes an unsteady idling operation, because the fuel injection interval is inconveniently increased during the idling operation. More specifically, if the valve-open period of the fuel injector is selected to be 5 ms at 3,000 R.P.M., the valve-open period will be shortened to 1 ms as the engine speed is decreased to the idling speed of 600 R.P.M. This valve-open period is too short for the valve-opening period of the intake valves during the idling operation which is typically 50 ms. Under such a condition, there is a considerably long period in which air is supplied solely, after each fuel injection, so that the whole intake air is not mixed with the fuel homogeneously to make the idle operation unsteady.

(2) It is desirable that the fuel injected from the fuel injector is atomized into fuel particles of particle sizes as small as possible, because the smaller particle size ensures a better driveability and emission control, as well as reduced fuel consumption rate. The particle size of the fuel particles injected from conventional fuel injectors is around 300$\mu$ which cannot be considered sufficiently small. Therefore, part of the fuel taken into the engine attaches to the wall of the cylinder and is emitted from the latter before it is burnt. The fuel attaching to the cylinder wall, on the other hand, dilutes the lubricating oil and increases the fuel consumption rate uneconomically.

Under these circumstances, the specification of U.S. Pat. No. 3,656,464 proposes a system intended for overcoming the above described problems of the prior art.

This system, however, is intended merely to effect a finer atomization of the fuel, and cannot eliminate the aforementioned considerably long period of air supply after each fuel injection during idling operation of the engine. Thus, this system cannot overcome the above-explained problem (1) of the prior art.

It is also to be pointed out that this system can atomize the fuel only to the order of 50 to 70$\mu$, which is considered still insufficient, particularly in view of current social concern about the exhaustion of oil resources.

SUMMARY OF THE INVENTION

It is, therefore, an object of the present invention to provide a fuel control device for a fuel injection system, capable of ensuring a steady and smooth engine operation particularly during an idling operation of the engine.

It is another object of the invention to provide a fuel control device for a fuel injection system, capable of atomizing the fuel to be supplied to the engine into finer particles.

To these ends, according to the invention, there is provided a fuel control device for a fuel injection system, having a tubular member made of a porous material and opened at its both ends. The porous tubular member has one end disposed near the fuel discharge orifice of a fuel injector, such that most part of the fuel discharged from the discharge orifice attaches to the inner peripheral surface of the porous tubular member. Also, means are provided for supplying air from the outside to the inside of the porous tubular member through the pores of the wall of the latter, so that the fuel flowing through the porous tubular member is sufficiently mixed with the air.

DESCRIPTION OF PREFERRED EMBODIMENTS

The invention will be more fully understood from the following description of the preferred embodiments taken in conjunction with the accompanying drawings. However, the description of the fuel injection system, to which the invention is applied, is omitted because it is known per se.

Figure 1:
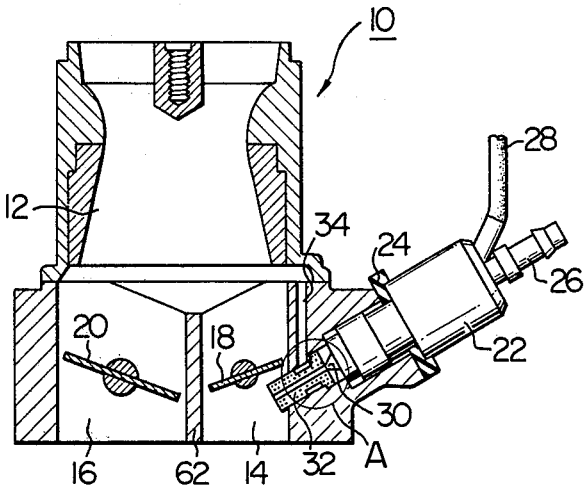
FIG. 1 is a vertical sectional view of a single point injection system incorporating a fuel control device embodying the present invention.

FIG. 1 shows a single point fuel injection system incorporating a fuel control device which is an embodiment of the invention. A throttle body generally designated by a reference numeral 10 has an intake passage 12 formed therein. The intake passage 12 is divided into two passage sections 14, 16 by a partition 62. One of these two passage sections is a primary passage 14, while the other is a secondary passage 16. The primary and the secondary passages 14 and 16 are provided with a primary throttle valve 18 and a secondary throttle valve 20, respectively. These throttle valves 18, 20 are operatively connected by a suitable connecting mechanism such that the secondary throttle valve 20 starts to open only after the primary throttle valve 18 has been opened to a predetermined opening. A mechanism similar to that of a known multi-stage carburetor can be used as this connecting mechanism.

A fuel injector 22 is fixed to the throttle body 10 through the medium of a rubber seal 24, and is adapted to be supplied with a fuel delivered by a fuel pump (not shown) through a pipe 26. The fuel injector 22 receives also an electric signal which is derived from a control unit (not shown) through electric conductors 28.

A tubular element 32 made of a porous material is disposed in the vicinity of a discharge orifice 30 of the fuel injector 22. The fuel injected from the fuel injector 22 is supplied to a portion of the primary passage 14 downstream from the primary throttle valve 18, through this tubular element 32. An air passage 34 is provided for supplying air to the outer periphery of the porous tubular element 32.

Figure 2:
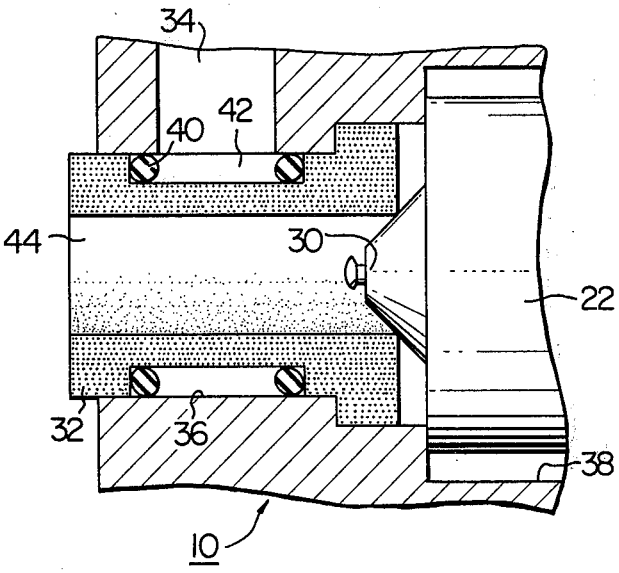
FIG. 2 shows in a larger scale the portion encircled by a circle A of FIG. 1.

Referring now to FIG. 2 showing the detail of the portion around the porous tubular element 32 in a larger scale, the fuel injector 22 is adapted to be mounted in a first bore 38 formed in the wall of the throttle body 10. The first bore 38 is in communication with a second bore 36. The porous tubular element 32 is a hollow tubular member opened at its both ends and is fixed to the inside of the second bore 36 through the medium of "O" rings 40. The annular space 42 defined by the "O" rings, inner peripheral surface of the second bore 36 and the outer peripheral surface of the porous tubular element 32 is communicated with the air passage 34.

The porous tubular element 32 is made of a sintered metal or a porous plastic having a good anti-gasoline characteristic. A multiplicity of minute passages are formed by pores across the thickness of the wall of the porous tubular element 32 so that the air supplied to the space 42 is made to flow through these minute passages into a mixture passage 44 defined in the porous tubular element 32. The porous tubular element 32 is disposed in close contact with the fuel injector 22 so that the discharge orifice 30 of the latter opens directly to the mixture passage 44.

According to the invention, it is quite important to arrange the porous tubular element 32 such that the air is allowed to flow into the mixture passage 44 only through the minute air passages formed through the wall of the porous tubular element 32 across the thickness of the latter. If there is any passage bypassing the minute passages formed in the porous tubular element 32, the flow rate of the air flowing through these minute passages will be decreased drastically.

Figure 3:
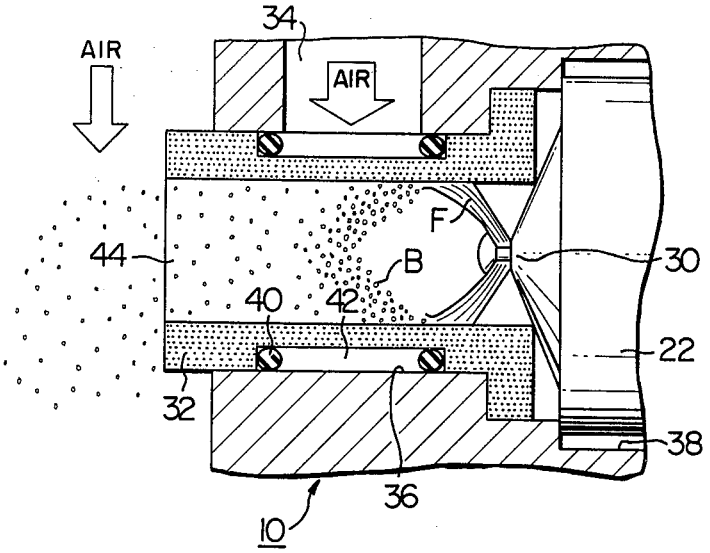
FIG. 3 is an illustration of the behaviour of the fuel and air in the fuel control device shown in FIG. 2.

The operation of the porous tubular element 32 will be described hereinunder with specific reference to FIG. 3.

As a signal for initiating the fuel injection is delivered through the electric conductor 28 to the fuel injector 22, the latter injects the fuel F through its discharge orifice 30. The flow of the fuel F discharged through the discharge orifice 30 diverges radially outwardly to collide with the inner peripheral surface of the mixture passage 44 and the fuel F adheres to that wall. As will be understood from an explanation which will be given later, this adherence of the fuel to the inner peripheral wall of the mixture passage 44 constitutes one of the important features of the invention. The fuel F adhering to the inner peripheral surface of the mixture passage 44 then flows on that surface and is instantaneously atomized into fine fuel particles by the air which is blown into the mixture passage 44 through the minute passages formed through the wall of the porous tubular element 32. The fine fuel particles B then flow through the mixture passage 44 and are inducted into the engine.

By effecting the described control on the fuel discharged from the fuel injector 22, it is possible to stabilize the engine speed, particularly the engine speed during a idling operation, to ensure a smooth and steady idle operation of the engine, for the reason which will be described hereinunder.

As stated in the hereinabove, the valve-open period of the fuel injector is much shorter than that of the intake valves during idle operation of the engine, so that air is solely supplied over a considerably long period after a short period of the fuel injection from the fuel injector, resulting in a heterogeneous mixing of the total intake air.

In sharp contrast to the above, according to the invention, the fuel is prevented from being supplied into the engine in a short period of time, by making an efficient use of fuel adherence characteristic of the porous material of the tubular element constituting the mixture passage 44. Namely, thanks to the fuel adhering characteristic of the porous material, most part of the fuel discharged from the fuel injector 22 is made to adhere to the inner peripheral surface of the mixture passage so that it is prevented from flowing into the engine immediately after the injection. In addition, the problem attributable to the adherence of the fuel to the inner peripheral surface of the mixture passage 44, i.e. the growth or coarsening of the fuel particles, is fairly overcome by the air which is supplied into the mixture passage 44 through the minute air passages formed across the wall thickness of the porous tubular element 32, because this air effectively atomizes the fuel into sufficiently small fuel particles to permit a homogeneous mixing of the total intake air with the fuel.

Figure 4:
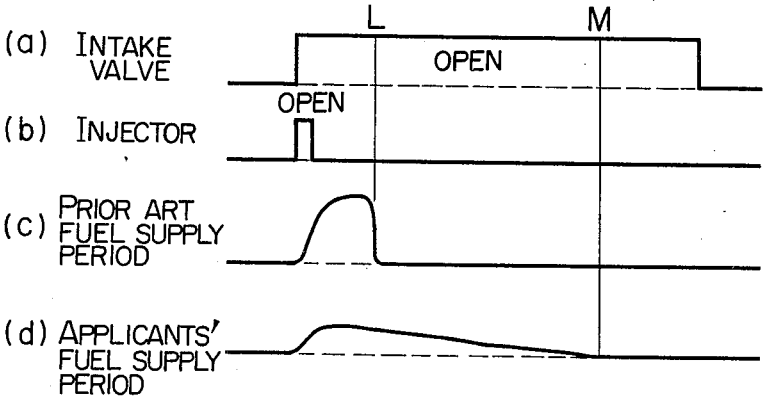
FIG. 4 is a time chart showing the valve-open periods of the intake valve and the fuel injector, as well as the period of supply of the fuel-air mixture to the engine.

This advantage will be more clearly understood from the following description taken in conjunction with FIG. 4 which is a time chart showing the valve-open periods of the intake valve and the fuel injector, as well as the period of the fuel supply during the idle operation of the engine. More specifically, charts (a) and (b) show the valve-open periods of the intake valve and the fuel injector, respectively, while charts (c) and (d) show the periods of fuel supply by a conventional fuel injector and a fuel injector of the invention, respectively.

As the intake valve is opened at a timing shown in the chart (a), a signal for initiating the fuel injection is delivered to the fuel injector, so that the latter opens as shown in the chart (b) to inject the fuel. In the conventional fuel injection system, the total of a charge of fuel is fed into the engine in quite a short period of time as shown in the chart (c). Therefore, after the fuel supply by the fuel injector is ceased, air is solely supplied until the intake valve is closed, so that the total intake air is not mixed with the fuel homogeneously. More specifically, in the conventional fuel injection system, the fuel is mixed only with a part of the intake air which is introduced during a short period between the moment at which the fuel injection is started and a moment "L" shown in the chart (a).

In sharp contrast to the above, as will be seen from the chart (d), the fuel is not supplied in short period of time, in the fuel injection system having the fuel control device of the invention. Rather, the fuel is supplied to the engine over almost whole period of opening of the intake valve. It is, therefore, possible to obtain a homogeneous mixing of the total intake air with the fuel. It will be seen that, according to the invention, the fuel and air supplied during idling are mixed homogeneously with each other to provide a steady and smooth idle operation of the engine.

In the fuel control device of the invention, the fuel is made to flow on the inner peripheral surface of the mixture passage formed in the porous tubular element. It is remarkable that the fuel flowing on the inner peripheral surface of the mixture passage is sufficiently atomized by the minute streams of air supplied into the mixture passage through the minute air passages which are peculiar to the porous nature of the tubular element constituting the mixture passage. Experiments conducted by the present inventors showed that the fuel particle size, which has been 300$\mu$ or so in the conventional fuel injection system, is reduced to 5 to 20$\mu$. Clearly, this fine atomization of the fuel contributes greatly to the improvements in the driveability, exhaust gas characteristic and fuel economy.

Hereinafter, a description will be made as to an application of the invention to the multi-point injection system.

Figure 5:
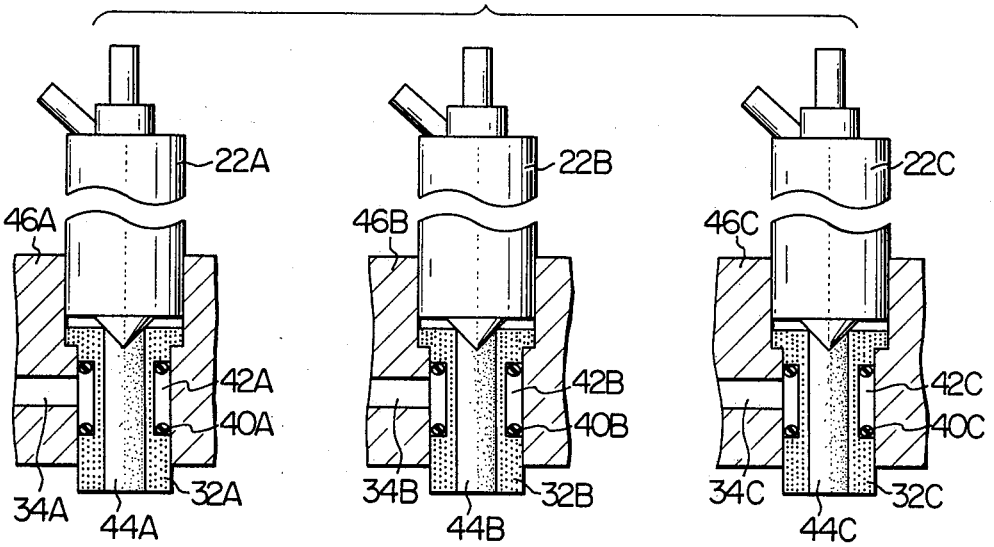
FIG. 5 is a vertical sectional view of an essential part of the fuel control device embodying the invention, applied to a multi-point injection system.

Referring to FIG. 5, a multicylinder internal combustion engine has, for example, four cylinders to which intake air is supplied through an intake manifold having branch pipes 46A, 46B and 46C. The branch pipe for the No. 4 cylinder is omitted from FIG. 5. The branch pipes 46A, 46B and 46C are provided with respective fuel injectors 22A, 22B and 22C to the outlet side ends of which attached are the porous tubular elements 32A, 32B and 32C. The porous tubular elements 32A, 32B and 32C cooperate with "O" rings 40A, 40B and 40C in defining air chambers 42A, 42B and 42C, respectively. These air chambers 42A, 42B and 42C are adapted to be supplied with air through air passages 34A, 34B and 34C. Thus, the arrangement is substantially identical to that described in connection with FIG. 2.

As the signals for the fuel injection are given to these fuel injectors 22A, 22B and 22C in sequence, these fuel injectors 22A, 22B and 22C operate to make the fuel injection. The injected fuel in each branch pipe of the intake manifold then spreads and diverges radially outwardly to collide with the inner peripheral surface of each mixture passage 44A (44B, 44C) constituted by the porous tubular element 32A (32B, 32C) to adhere to that surface. The behaviour of the fuel after the adherence to the inner periheral surface of each mixture passage is identical to that explained in connection with FIG. 3.

It will be seen that the fuel control device of the invention makes it possible to homogeneously mix the total intake air with the injected fuel to permit a finer atomization of the fuel even in case of the multi-point fuel injection system.

Hereinafter, another embodiment of the invention will be described with specific reference to FIG. 6.

Figure 6:
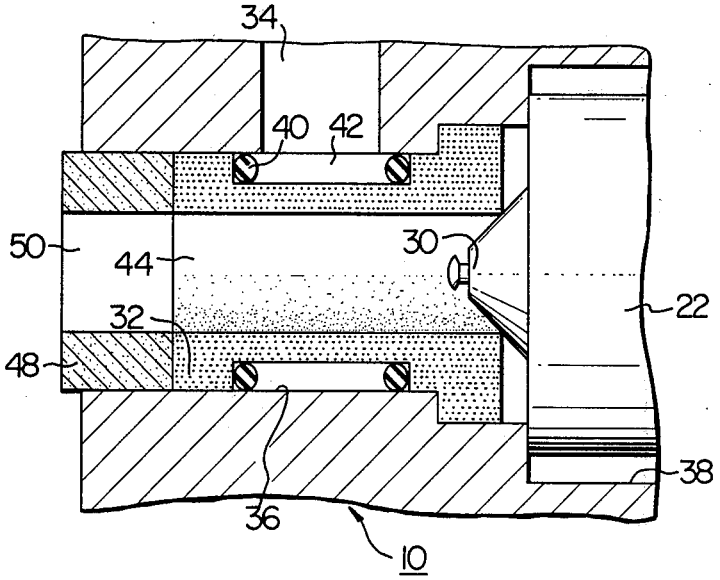
FIG. 6 is an enlarged cross sectional view, similar to FIG. 2, of another embodiment of a fuel control device constructed in accordance with the present invention.

Referring to FIG. 6, a heater 48 is provided at the end of the porous tubular element 32 in close contact with the latter. The heater 48 is a PTC ceramic heater having a positive temperature coefficient, and is fitted to the bore 36. A mixture passage 50 is defined in the heater 48. The arrangement is such that the fuel and air are supplied to the engine through the mixture passage 50 of the heater 48.

This heater 48 will act as follows:

Assuming that the fuel is discharged from the discharge orifice 30 of the fuel injector, the fuel adheres to the inner peripheral surface of the mixture passage 44 constituted by the porous tubular element 32 and flows on that surface. Meanwhile, air is jetted into the mixture passage 44 from the air chamber 42 to finely atomize the fuel adhering to and flowing on the inner peripheral surface of the mixture passage 44. The finely atomized fuel then flows toward the downstream side to reach the mixture passage 50 of the heater 48. By the heat delivered by the heater 48, the fuel particles are expanded and ruptured to be further atomized into finer particles. The remainder fuel particles, which have not ruptured in the mixture passage 50, are subjected to a drastic pressure drop when they are released into the intake passage of the engine and, accordingly, are ruptured to be further atomized into finer particles.

Hereinafter, a description will be made as to the preferred forms of the intake system of the engine usable in combination with the fuel injection system having a fuel control device of the invention.

The fuel control device of the invention atomizes the fuel making use of a porous tubular element 32. In case of a single point injection, since the porous tubular element 32 opens to the portion of the intake passage immediately downstream from the throttle valve, the fuel particles, which have been atomized by the fuel control device of the invention, may inconveniently be aggregated to form particles of larger sizes, due to the turbulent flow of the intake air which has passed the throttle valve. It is, therefore, necessary to arrange such that the fuel particles atomized by the porous tubular element 32 are transferred to the intake air flow in a manner to avoid the aggregation of the fuel particles.

Figure 7:
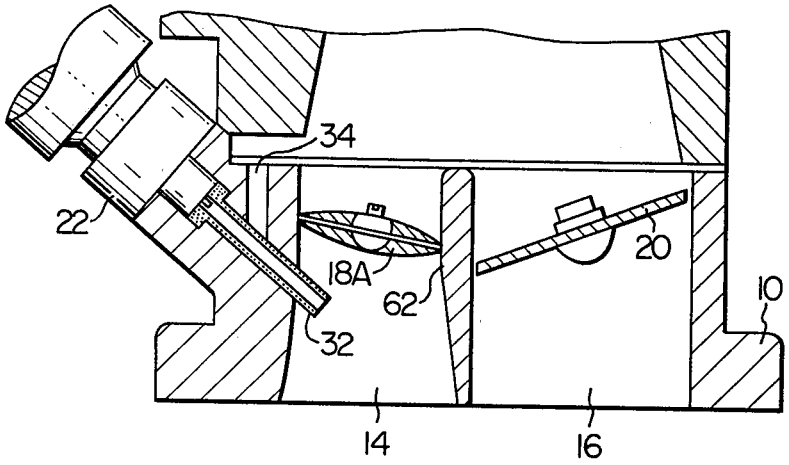
FIGS. 7, 8 and 9 are vertical sectional views of preferred forms of intake system having a fuel injection system which incorporates the fuel control device of the invention.

FIG. 7 shows an example of the intake system which is designed and constructed to permit the transfer of the atomized fuel particles in good order to the intake air flow. This intake system is characterized in that a throttle valve 18A disposed at the upstream side of the porous tubular body 32 has a streamline shape. The streamline shape of the throttle valve 18A is effective in preventing the undesirable separation of layers of air flowing along the surface of the valve 18A. In consequence, the fuel particles atomized in the porous tubular element are transferred to the intake air flow in a manner to avoid the undesirable coarsening of the fuel particles before they are conveyed into the engine.

A preferred form of the intake manifold is as follows:

Generally, an intake manifold is provided at its portion between the branching point and the throttle body with an enlarged-diameter portion which is intended for providing a supercharging effect making use of the inertia of the intake air flow. This enlarged-diameter portion, however, lowers the velocity of the intake air, particularly in the operation range of small intake air flow rate. As a result, the fuel particles flying together with the intake air are also decelerated due to the reduction of the flowing velocity to cause local enrichment or fluctuation of the richness of the mixture and/or adherence of the fuel particles to the inner surface of the enlarged-diameter portion of the manifold.

Figure 8:
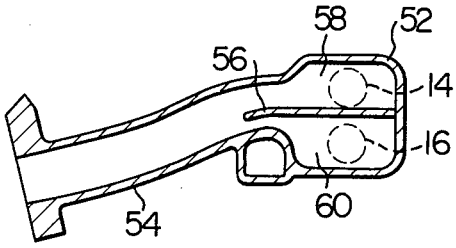

In order to eliminate this unfavourable phenomenon, a construction as shown in FIG. 8 can effectively be used. Referring to FIG. 8, an enlarged-diameter portion 52 is connected at its one end to the throttle body 10 and, at its other end, to respective cylinders through branch pipes 54. The space in the enlarged-diameter portion 52 is divided into two sections: a primary chamber 58 and a secondary chamber 60, by a partition plate 56 connected to a partition wall 62 which separates the primary passage 14 and the secondary passage 16 provided in the throttle body 10 from each other.

Therefore, when the primary throttle valve 18 operates, the air is introduced solely through the primary chamber 58 of the enlarged-diameter portion 52 so that a comparatively high flow velocity of the intake air is obtained to eliminate the undesirable fluctuation of richness of the mixture and adherence of the fuel particles to the wall of the enlarged-diameter portion 52. Then, as the secondary throttle valve 20 is put into effect, the intake air is allowed to flow through both of the primary and the secondary passages 58, 60, so that the supercharging effect provided by the inertia of the intake air flow is never deteriorated.

According to the invention, the fuel can effectively be atomized by means described hereinunder during low-speed operation with the throttle valve fully opened.

Generally, during low-speed operation of the engine with full throttle opening, the vacuum established at the downstream side of the throttle valve is not so high, so that the air is introduced into the porous tubular element 32 only at a small rate, because of the low vacuum at the downstream side of the throttle valve, resulting in an insufficient atomization of the fuel injected by the fuel injector.

Figure 9:
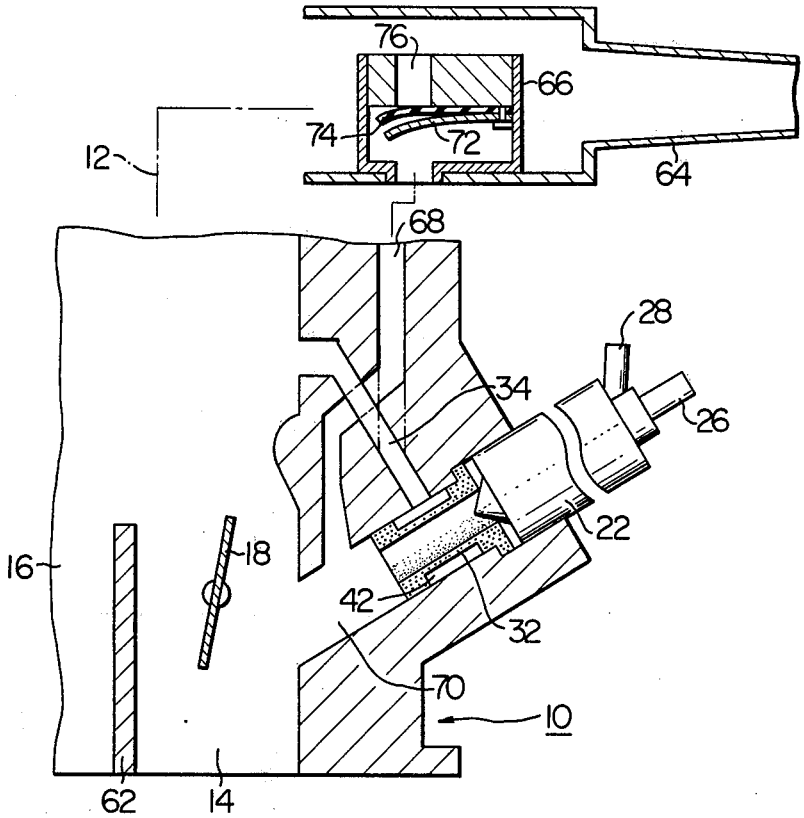

According to the invention, this phenomenon is fairly overcome by adopting a measure as illustrated in FIG. 9.

In the arrangement shown in FIG. 9, the intake passage 12 in the throttle body 10 is in communication with an air cleaner 64 which incorporates a reed valve 66. The reed valve 66 is communicated with a mixing chamber 70 in the throttle body 10, through an air passage 68. The mixing chamber 70 is formed between the primary passage 14 downstream from the primary throttle valve 18 and the porous tubular element 32. The reed valve 66 is constituted by a stopper 72, a valve member 74 made of a resilient member and a passage 76. The valve member 74 is adapted to normally close the passage 76 due to its resiliency.

Figure 10:
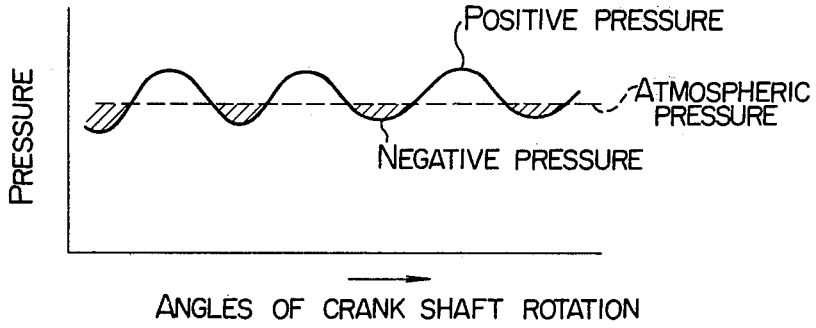
FIG. 10 is a graph showing the relationship between the pressure in the intake system and the crank shaft rotation.

Generally, during low-speed engine operation with full throttle opening, a pulsation of pressure consisting of alternatingly repeated positive and negative pressures is generated in the portion of the intake passage downstream from the air cleaner 64, in accordance with the angles of the crank shaft rotation, as shown in FIG. 10. It is possible to promote the atomization of the fuel by forcibly feeding the air into the mixing chamber 70 and by an efficient use of this pulsation of the air pressure.

When the engine speed is low and the throttle valve 18 is opened fully, the pulsation of the air pressure is taking place around the reed valve 66, in the manner shown in FIG. 10. Therefore, the valve member 74 is deflected to open the passage 76 to permit the air supply to the mixing chamber 70 only when the "negative" pressure is acting on the reed valve 66. This air effectively atomizes the fuel flowing along the porous tubular element 32 to supply a good mixture to the engine. However, when the "positive" pressure is acting on the reed valve 66, the valve member 74 resumes the closed position due to its resiliency so that the air supply to the passage 68 is stopped. It will be seen that this arrangement makes it possible to forcibly supply the air into the mixing chamber 70 to promote the atomization of the fuel, even when the engine is operating at a low speed with the throttle valve 18 fully opened.

The arrangement shown in FIG. 9 may be modified such that the air passage 68 is communicated with the air chamber 42 by a passage shown by broken lines to permit the supply of the air from the reed valve 66 to the air chamber 42.

Preferred forms of the intake system suitable for use in combination with the fuel injection system having the fuel control device of the invention have been described. It will be clear to those skilled in the art that these preferred forms are selectively used in combination.

As has been described, according to the invention, a hollow porous tubular element 32 opened at its both ends is disposed such that one of the opened ends thereof is positioned in the vicinity of the fuel discharge orifice 30 of the fuel injector 22. Most part of the fuel injected through the discharge orifice 30 is made to adhere to the inner peripheral surface of the porous tubular element 32. Meanwhile, air is fed into the porous tubular element 32 from the space around the latter, through the minute air passages formed across the wall thickness of the porous tubular element, to thereby form a homogeneous mixture with the fuel adhering to the inner peripheral surface of the porous tubular element. Since the total intake air induced during the suction stroke during idling is homogeneously mixed with the fuel to ensure a steady and smooth idle operation of the engine. In addition, since the air is allowed to flow into the porous tubular element 32 in the form of fine streams only through the minute air passages formed across the wall thickness of the porous tubular element 32, while the injected fuel is adhering to and flowing on the inner peripheral surface of the porous tubular element.

In consequence, the fuel is effectively atomized into particles of small particle sizes which could never be attained by the conventional atomizer or the like, means to effectively improve the driveability, exhaust gas characteristic and fuel economy of the internal combustion engine.

What is claimed is:

1. A fuel control device for a fuel injection system of a type having an intake passage adapted for supply air into an internal combustion engine and a fuel injector adapted for intermittently injecting a fuel into the intake air flowing through said intake air passage, said fuel control device comprising: a porous tubular element defining therein a passage opened at its both ends, said porous tubular element being disposed between a discharge orifice of said fuel injector and said intake passage such that the most part of the fuel injected through said discharge orifice of said fuel injector is made to collide with and adhere to an inner peripheral surface of said porous tubular element; and means for supplying air from a space around said porous tubular element into said passage in said porous tubular element through a wall of said porous tubular element to thereby form an air-fuel mixture in said passage in said porous tubular element.

2. A fuel control device for an internal combustion engine having an intake passage adapted for supplying air into the internal combustion engine, the supply system comprising:

a fuel injector mounted in a wall of said intake passage, a bore provided in the wall, said bore extending between an inner end of said injector and said intake passage, a porous tubular element disposed in said bore, said porous tubular element having a first open end opening into said intake passage and a second open end disposed within said bore, said porous tubular element defining therein a substantially straight mixture passage extending between said first and second open ends of said tubular element, the inner end of said fuel injector is disposed in sealing engagement with said second open end of said porous tubular element to prevent any air flow through said second open end into said mixture passage, said fuel injector having a fuel discharge orifice extending through said second open end into said mixture passage and being operative to intermittently inject and at a positive pressure a liquid fuel into said mixture passage such that the injected fuel diverges radially outwardly and collides against and adheres to the inner peripheral surface of said mixture passage, an outer peripheral surface of said porous tubular element includes an area of a predetermined axial dimension cooperating with said bore to define an annular space, and an air passage for feeding air into said annular space, whereby the air flows from the annular space into said mixture passage through the outer peripheral surface area of said porous tubular element.

3. A fuel control device for a fuel injection system of the type having an intake passage adapted for supplying air into an internal combustion engine and a fuel injector adapted for intermittently injecting a fuel into the intake air flowing through said intake air passage, said fuel control device comprising a porous tubular element defining therein a passage open at both ends, said porous tubular element being disposed between a discharge orifice of said fuel injector and said intake passage such that most of the fuel injected through said discharge orifice of said fuel injector is made to collide with and adhere to an inner peripheral surface of said porous tubular element, means are provided for supplying air from a space around said porous tubular element into said passage in said porous tubular element through a wall of said porous tubular element to thereby form an air-fuel mixture in said passage in said porous tubular element, said porous tubular element and said fuel injector are disposed in a bore formed in a wall defining said intake passage in such a manner that one end of said porous tubular element is positioned in close contact with said fuel injector, said means for supplying air includes an air passage through which air is introduced to at least a part of said space around said porous tubular element, said fuel injector, porous tubular element, and said air passage are provided in a throttle body having a primary passage provided with a primary throttle valve and a secondary passage provided with a secondary throttle valve, a second air passage different from said air passage is formed in said throttle body, said second air passage providing an indication between said bore through which said porous tubular element is communicated with a portion of said primary passage downstream from said primary throttle valve and the intake passage upstream from said primary and secondary throttle valves, and a check valve disposed in said second air passage and adapted to permit the air to flow only in the direction toward said bore.

4. A fuel control device as claimed in claim 1, wherein said porous tubular element and said fuel injector a are disposed in a bore formed in the wall defining said intake passage in such a manner that one end of said porous tubular element is positioned in close contact with said fuel injector, and wherein said means for supplying air include an air passage through which air is introduced to at least a part of said space around said porous tubular element.

5. A fuel control device as claimed in one of claims 4 or 2, wherein airtight seal members are interposed between an inner peripheral surface of said bore and the portions of the outer peripheral surface of said porous tubular element other than the portion to which said air passage opens.

6. A fuel control device as claimed in one of claims 4 or 2, wherein said porous tubular element is made of a sintered metal.

7. A fuel control device as claimed in one of claims 4 or 2, wherein said porous tubular element is made of a plastic resistant to gasoline.

8. A fuel control device as claimed in one of claims 4 or 2, wherein a heater is disposed at the end of said porous tubular element opposite to said fuel injector.

9. A fuel control device as claimed in claim 8, wherein said heater is a hollow ceramic heater having a positive temperature coefficient defining therein a passage opening at its both ends, said ceramic heater being fitted to an inside of said bore and disposed in close contact with said porous tubular element.

10. A fuel control device as claimed in one of claims 4 or 2, wherein said fuel injector, porous tubular element and an end of said air passage are disposed at a position of said intake passage downstream from a throttle valve and upstream from a point at which said intake passage is branched into branch pipes leading to respective cylinders of said internal combustion engine.

11. A fuel control device as claimed in one of claims 4 or 2, wherein said fuel injector, porous tubular element and said air passage are provided in a throttle body having a primary passage provided with a primary throttle valve and a secondary passage provided with a secondary throttle valve and are disposed at a portion of said primary passage downstream from said primary throttle valve.

12. A fuel control device as claimed in claim 11, wherein a second air passage different from said air passage is formed in said throttle body, said second air passage providing a communication between said bore through which said porous tubular element is communicated with the portion of said primary passage downstream from said primary throttle valve and the intake passage upstream from said primary and secondary throttle valves; and a check valve disposed in said second air passage and adapted to permit the air to flow only in the direction toward said bore.

13. A fuel control device as claimed in claim 10, wherein a space in a portion of said intake passage between the point at which said intake passage is branched into branch pipes leading to respective cylinders of said internal combustion engine and said primary throttle valve is divided into two passages by a partition plate.

14. A fuel control device as claimed in one of claims 4 or 2, wherein a combination of said fuel injector, porous tubular element and said air passage is provided in each branch pipe of an intake manifold constituting said intake passage.

* * * * *